US010818136B2

(12) United States Patent
Hsu et al.

(10) Patent No.: US 10,818,136 B2
(45) Date of Patent: Oct. 27, 2020

(54) GAME SYSTEM CAPABLE OF TRIGGERING PRIZE MONEY BY MULTIPLE BETTING

(71) Applicant: JUMBO TECHNOLOGY CO., LTD., Taichung (TW)

(72) Inventors: Shun-Tsung Hsu, Taichung (TW); Chang-Yi Wang, Taichung (TW); Chia-Ching Fu, Taichung (TW)

(73) Assignee: JUMBO TECHNOLOGY CO., LTD., Taichung (TW)

( * ) Notice: Subject to any disclaimer, the term of this patent is extended or adjusted under 35 U.S.C. 154(b) by 42 days.

(21) Appl. No.: 16/225,708

(22) Filed: Dec. 19, 2018

(65) Prior Publication Data

US 2020/0202667 A1 Jun. 25, 2020

(51) Int. Cl.
*G07F 17/32* (2006.01)

(52) U.S. Cl.
CPC ..... *G07F 17/3244* (2013.01); *G07F 17/326* (2013.01); *G07F 17/3209* (2013.01); *G07F 17/3211* (2013.01)

(58) Field of Classification Search
None
See application file for complete search history.

(56) References Cited

U.S. PATENT DOCUMENTS 8,157,641 B2 * 4/2012 Englman ..... G07F 17/32 463/20
9,542,806 B2 1/2017 Gilbertson et al.
2004/0063485 A1 * 4/2004 Webb ..... A63F 3/00157 463/16
2005/0239542 A1 * 10/2005 Olsen ..... G07F 17/32 463/27
2006/0035694 A1 * 2/2006 Fuller ..... G07F 17/32 463/13
2006/0040735 A1 * 2/2006 Baerlocher ..... G07F 17/32 463/26
2007/0054733 A1 * 3/2007 Baerlocher ..... G07F 17/32 463/27
2007/0060321 A1 * 3/2007 Vasquez ..... G07F 17/32 463/27
2009/0075712 A1 * 3/2009 Englman ..... G07F 17/32 463/17
2009/0088244 A1 * 4/2009 Nicely ..... G07F 17/32 463/27

(Continued)

*Primary Examiner* — Seng H Lim
(74) *Attorney, Agent, or Firm* — Muncy, Geissler, Olds & Lowe, P.C.

(57) ABSTRACT

The present invention relates to a game system allowing at least one prize money value to correspond to at least one optional betting option respectively. After a player bets on the at least one optional betting option, the at least one prize money value corresponding to the at least one optional betting option that has been betted may be activated, such that the player has an opportunity to obtain the at least one prize money value that has been activated. Therefore, the game system of the present invention can induce the player to bet on the optional betting option by virtue of the presence and display of the prize money values, as well as the player's desire to obtain the prize money values, thereby increasing the willingness of the player to raise bets and the revenue of the game system.

42 Claims, 12 Drawing Sheets

(56) References Cited

U.S. PATENT DOCUMENTS

| | | | | |
|---|---|---|---|---|
| 2009/0209315 | A1* | 8/2009 | Hall | G07F 17/3258 463/20 |
| 2014/0094293 | A1* | 4/2014 | Nicely | G07F 17/3246 463/27 |
| 2014/0187313 | A1* | 7/2014 | Arnone | G07F 17/3225 463/25 |
| 2014/0194182 | A1* | 7/2014 | Young | G07F 17/3213 463/20 |
| 2016/0189482 | A1* | 6/2016 | Czyzewski | G07F 17/3272 463/16 |
| 2016/0314656 | A1* | 10/2016 | Book | G07F 17/3258 |
| 2019/0347902 | A1* | 11/2019 | Hsu | G07F 17/3211 |

* cited by examiner

GAME SYSTEM CAPABLE OF TRIGGERING PRIZE MONEY BY MULTIPLE BETTING

FIELD OF THE INVENTION

The present invention relates to a game system, in particular to a game system capable of triggering prize money by multiple betting.

BACKGROUND OF THE INVENTION

The game system provides a game for a player to use a gaining machine disposed in a game room or a home electronic device disposed in a private home space to perform the game at low management cost, and can be applied to various games such as a Slot machine, poker game, Sic Bo and Roulette, thereby being widely welcomed by players and dealers. In order to increase the excitement and variability of the traditional game system, there will be a design of a prize money pool (a prize money servo device), which will allocate a certain proportion of bet amounts when the players bet and accumulate it into the prize money pool. When the game satisfies certain conditions and the player can get the prize money in the prize money pool, the player will be attracted by continuously increasing prize money in the prize money pool, and continue to play the game to effectively increase the turnover.

At present, the prize money in the prize money pool will be subjected to a multi-level design, which means that the prize money pool can have a plurality of prize money values. For example, the starting values of the prize money from small to large are different awards, i.e., Mini, Minor, Major, Maxi and Grand, etc., and the prize money values are accumulated independently. At the same time, the plurality of prize money values are calculated respectively to determine whether to qualify for the prize money or to enter the prize money game. Most of the prize money pools having a plurality of prize money values are accumulated by a plurality of gaining machines online, which not only makes the prize money values accumulate more quickly, but also satisfies the players' expectation of winning different sizes of prize money values.

In order to increase the turnover of the game system, the conventional game determines the number of the plurality of prize money values to be activated by the game system according to the amount of player's bets. In general, as the amount of bets increases, the plurality of prize money values will be gradually activated from small to large, in order to encourage players to increase the amount of bets. The similar technique is discloses in FIG. 24 and the corresponding description in U.S. Pat. No. 9,542,806 "Methods and systems for electronic gaining". However, as described in the previous US patent, the correspondence between awards and bet amount is fixed, so the player can only bet according to the bet amount set by the game, and can't switch the bets at any time only for several specific prize money values the player wants. However, the traditional technologies cannot specifically activate the desired prize money value according to the needs of the players, and the players may need to gradually activate a plurality of unwanted prize money values prior to activating the desired prize money values, which may cause the player to feel uneconomical. Moreover, since the prize money values are independently accumulated and whether the prize money are paid out or not is operated independently, it is often found in practice that the plurality of prize money values are not always sorted according to a predetermined starting value. It is possible that the prize money value for smaller awards, because it is less frequently won, has a greater value than the prize money value for the slightly larger awards. Therefore, the prize money design of the conventional game system cannot provide sufficient attraction for the player to continue playing.

SUMMARY OF THE INVENTION

The main objective of the present invention is to disclose a game system in which a player can activate corresponding prize money values by selecting betting options.

To fulfill said objective, the present invention provides a game system capable of triggering prize money by multiple betting, for a player to perform a slot game. The game system includes a point unit, a game result generating unit, an operation interface, a prize money pool unit, a display unit, a payout unit and a control unit. The point unit is configured to retrieve any one of a ticket and an account data, and generate a point signal according to a point in the ticket and the account data. The game result generating unit, in the case where the slot game has a plurality of slots arranged in a matrix form and a plurality of game symbols, configured to randomly select game symbols from the plurality of game symbols and display them on the slots, and determine a game result and generate a game image.

The operation interface has a mandatory betting option and at least one optional betting option and is configured for a player to perform betting on the mandatory betting option and the at least one optional betting option, and generate a corresponding mandatory betting signal and at least one optional betting signal according to the bet amount of the mandatory betting option and the at least one optional betting option. The prize money pool unit has a database for storing at least one prize money value, the at least one prize money value corresponding to any one of the optional betting options respectively.

The display unit is configured to display the game image; the payout unit is configured to pay out on the player. The control unit is connected to the point unit, the game result generating unit, the operation interface, the prize money pool unit, the payout unit and the display unit and is configured to control the game to undergo the following steps:

Step S1: generating a betting signal, wherein the control unit activates the operation interface for the player to operate after receiving the point signal generated by the point unit; and the operation interface generates the mandatory betting signal and the at least one optional betting signal according to the operations of the player, and modifies the point signal to deduct a portion for betting;

Step S2: activating a prize money value, wherein the control unit controls the prize money pool unit to activate the corresponding at least one prize money value after obtaining the mandatory betting signal and the at least one optional betting signal; and the control unit controls the display unit to display the at least one prize money value that has been activated and controls the prize money pool unit to obtain the bet amounts of the mandatory betting signal and the at least one optional betting signal, such that the prize money pool unit allocates a rated proportion of the bet amounts of the mandatory betting signal and the at least one optional betting signal as an allocation value, and controls the prize money pool unit to cause the database to accumulate the allocation value and to increase the at least one prize money value;

Step S3: calculating a bet raising probability, wherein the control unit calculates a corresponding bet raising probability respectively according to the bet amount of the at least one optional betting signal, and randomly generates a corresponding random prize money numeral code;

Step S4: determining whether to trigger the prize money value, wherein the control unit determines whether a prize money triggering condition corresponding to the at least one prize money value is satisfied according to the bet raising probability and the random prize money numeral code; and the control unit controls the display unit to display the at least one prize money value when the prize money triggering condition is satisfied, and controls the database of the prize money pool unit to reset the triggered at least one prize money value to an initial value;

Step S5: performing payout, wherein after the game result generating unit generates the game result, the control unit controls the payout unit to modify the point signal to increase a payout portion to pay out on the player according to the game result, the mandatory betting signal, the at least one optional betting signal and the triggered prize money value.

Furthermore, the game system of the present invention is further configured for a player to perform a slot game by using a home electronic device, wherein the home electronic device is provided with a display screen and an operation interface; the game system is formed inside a server; the server is provided with a communication unit allowing the server and the home electronic device to be connected through signals for intertransmission of communication data, such that the player performs the slot game via the display screen and the operation interface of the home electronic device.

As described above, the game system of the present invention is mainly characterized in that the prize money value corresponds to the optional betting option, and the mandatory betting signal and the optional betting signals are generated according to player's operations, such that the control unit controls the prize money pool unit to activate the corresponding prize money value after obtaining the mandatory betting signal and the optional betting signal, and controls the display unit to display the prize money value that has been activated. Therefore, the game system of the present invention can induce the player to bet on the optional betting option by virtue of the presence and display of the prize money values, as well as the player's desire to obtain the prize money values, thereby increasing the willingness of the player to raise bets and the revenue of the game system.

DETAILED DESCRIPTION OF THE PREFERRED EMBODIMENTS

Figure 1:
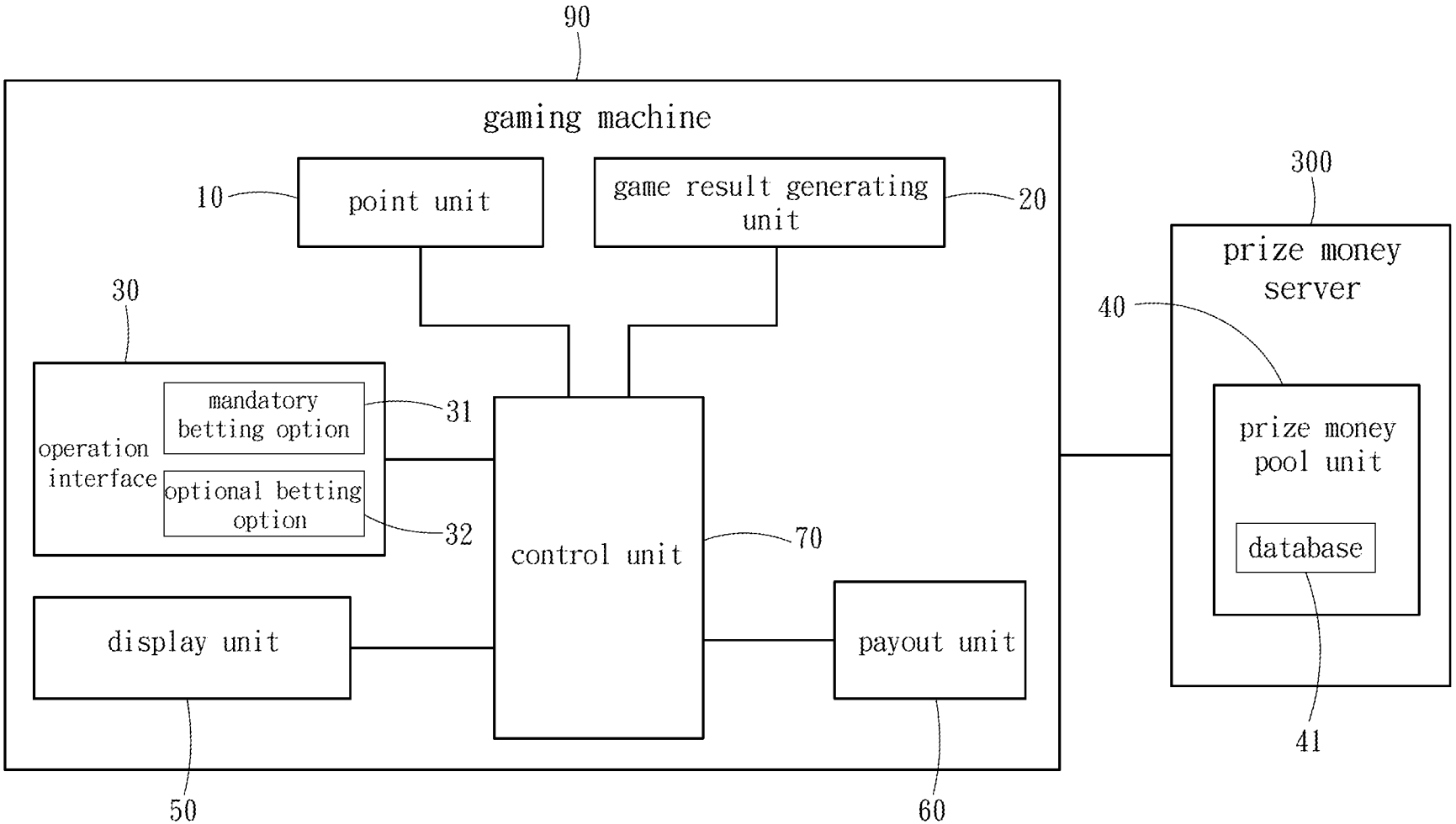
FIG. 1 is an architecture diagram of a system of the present invention.

The detailed description of the present invention will now be described below in conjunction with the drawings:

FIGS. 1, 2, 3 and 4 illustrate a system architecture diagram, a schematic diagram of a gaining machine, an operating flowchart and a schematic diagram of a game image in a preferred embodiment of the present embodiment. As shown in FIGS. 1, 2, 3 and 4, the present invention relates to a game system capable of triggering prize money by multiple betting. The present invention is provided for a player to perform a slot game. The game system comprises a point unit 10, a game result generating unit 20, an operation interface 30, a prize money pool unit 40, a display unit 50, a payout unit 60 and a control unit 70, wherein the point unit 10, the game result generating unit 20, the operation interface 30, the display unit 50, the payout unit 60 and the control unit 70 may be integrated on a gaining machine 90. Under this architecture, the game system may be a multiplayer online prize money game or a stand-alone prize money game. For the multiplayer online prize money game, prize money values are accumulated jointly by a plurality of gaining machines, and the prize money pool unit 40 is independently disposed in a prize money server 300 connected to the gaining machine 90, that is, as shown in FIG. 1, the prize money server 300 may be connected to other gaining machines. For the stand-alone prize money game, the prize money values are accumulated only by a single gaining machine, and the prize money pool unit 40 is also disposed in the gaming machine 90 (not shown in drawings).

The point unit 10 retrieves any one of a ticket data of a ticket and an account data and generates a point signal according to a point stored in the ticket date or the account data. The ticket may be a paper sheet, a ticket card, a magnetic card, NFC, RFID or other medium that can record data, or even can be logged in by scanning a barcode with a mobile phone. The account data can be recorded in the memory of the ticket or a web server. In addition, after the point unit 10 generates the point signal and transmits the point signal to the control unit 70, the control unit 70 controls the display unit 50 to display a point value corresponding to the point signal.

Figure 4:
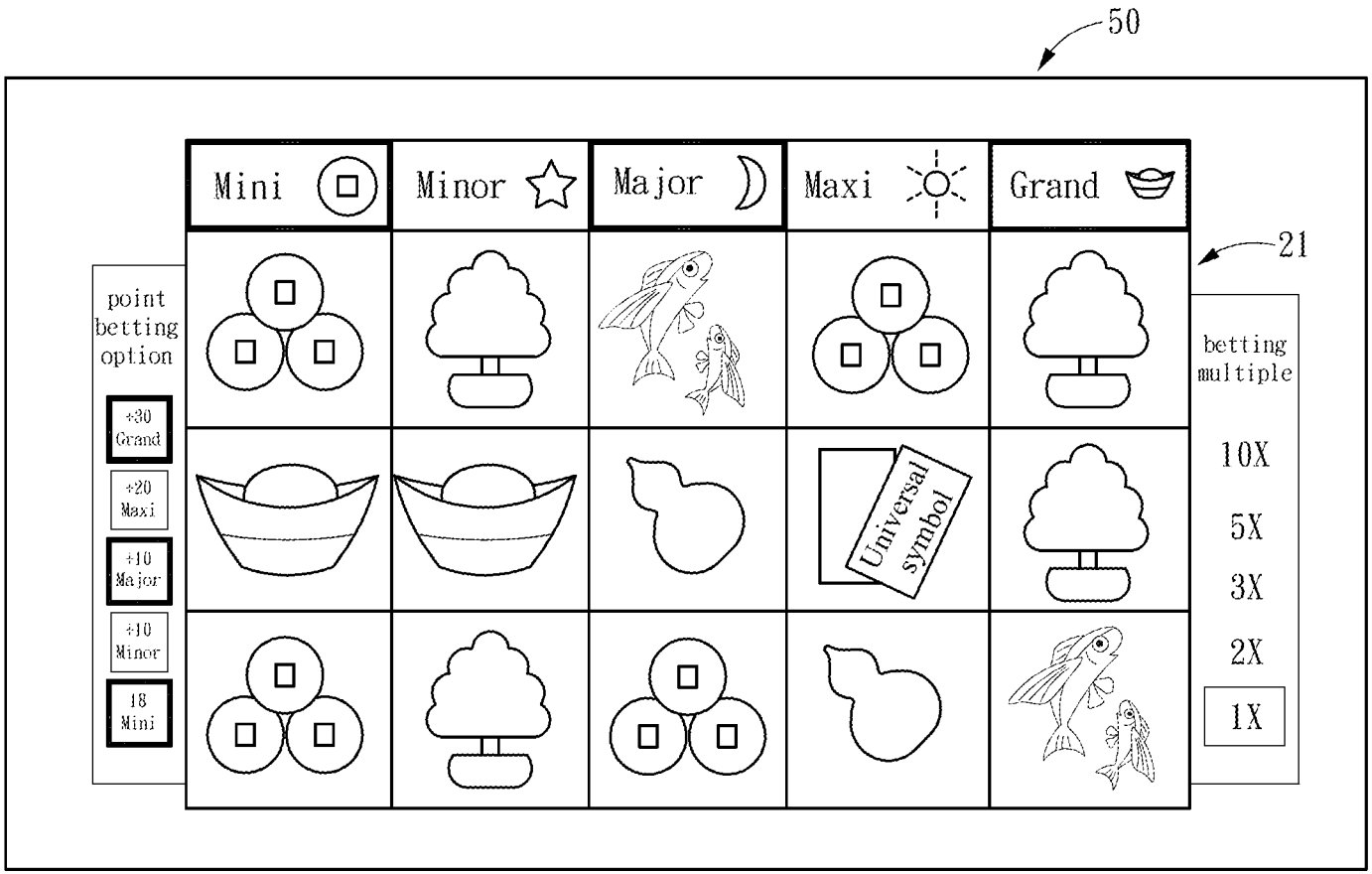
FIG. 4 is a schematic diagram of a game image of the present invention.

As shown in FIG. 4, the slot game has a plurality of slots 21 which are arranged in a matrix form and a plurality of game symbols, such as coins, fish, gourds, trees, etc. illustrated in the FIG. 4. The game result generating unit 20 randomly selects game symbols from the plurality of game symbols and presents the same on the slots 21, thus determines a game result and generates a game image, and displays the game image on the display unit 50. It should be noted that the arrangement of the slots in the slot game is not limited to a 4×5 matrix in FIG. 4, and may be 3×3, 4×5, or a plurality of slots are arranged in other shapes such as a triangle or a diamond.

Figure 5:
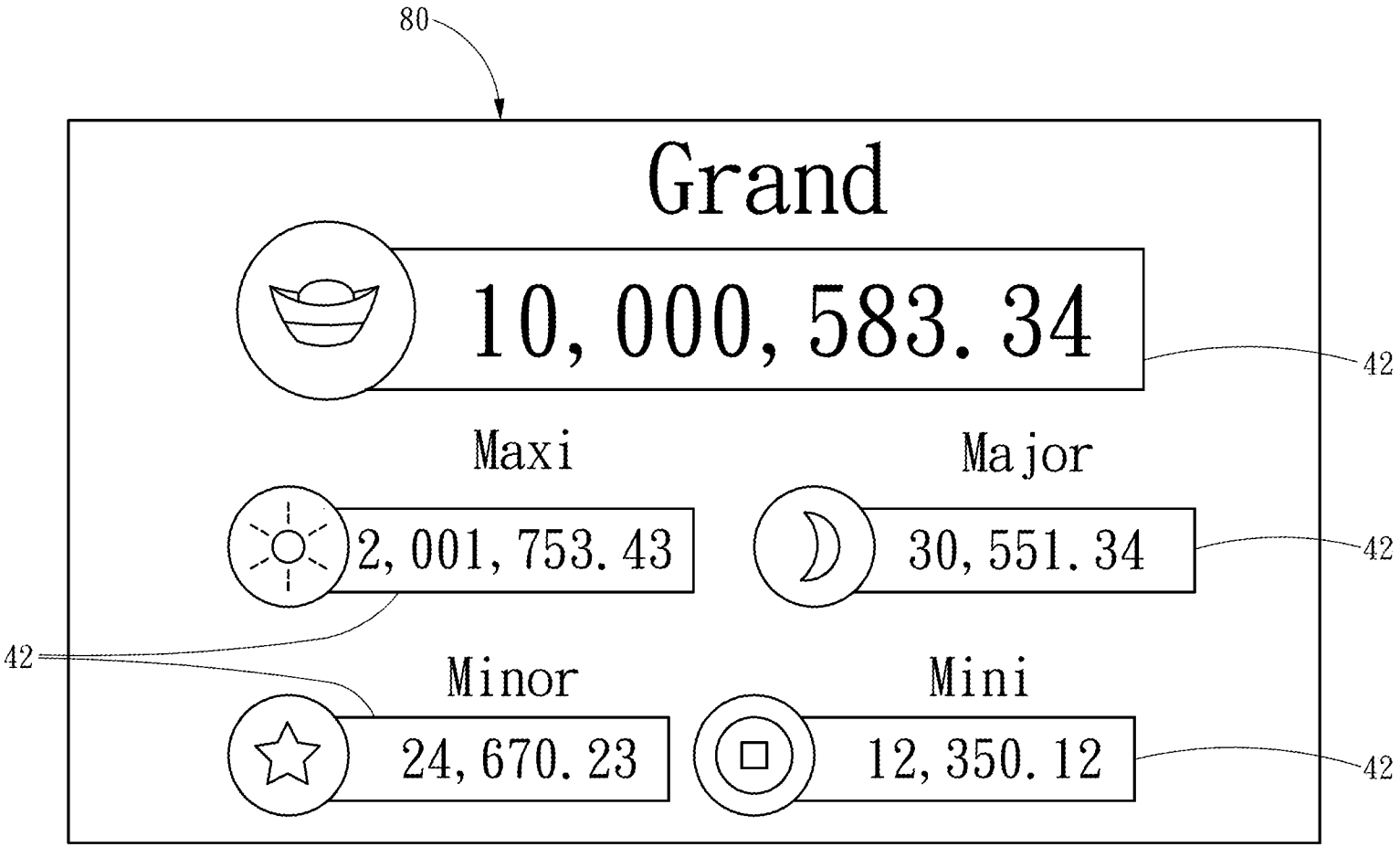
FIG. 5 is a schematic diagram of the display of a prize money value of the present invention.

As shown in FIGS. 1 and 5, the prize money pool unit 40 has a database 41 that stores a plurality of prize money values 42. The plurality of prize money values 42 are accumulated from different starting values, and can be classified into Mini, Minor, Major, Maxi, Grand, etc. according to the starting values from small to big. The prize money values 42 have respective numerical values and are independent of each other and can be displayed on a prize money screen 80 for the player to know the numerical values of the plurality of prize money values 42.

As shown in FIGS. 1, 2, 4, 6 and 7, the operation interface 30 has a mandatory betting option 31 and a plurality of optional betting options 32. The mandatory betting option 31 and the optional betting options 32 respectively correspond to at least one of a point betting option, a betting multiple or a total bet amount.

In the embodiments shown in FIGS. 4, 6, 7, 8, 9 and 10, the mandatory betting option 31 and the plurality of optional betting options 32 correspond to the point betting options. The operation interface 30 is configured for the player to perform betting on the mandatory betting option 31 and the plurality of optional betting options 32. The operation interface 30 generates a corresponding mandatory betting signal and a plurality of corresponding optional betting signals according to the bet amounts of the mandatory betting option 31 and of the optional betting options 32. In more detail, in the embodiments shown in FIGS. 4, 6 and 7, the mandatory betting option 31 and the plurality of optional betting options 32 may correspond to a point betting option 18, a point betting option +10, a point betting option +10, a point betting option +20 and a point betting option +30. In other embodiments, when the mandatory betting option and the plurality of optional betting options correspond to the betting multiples, the mandatory betting option and the plurality of optional betting options may correspond to a betting multiple 1×, a betting multiple 2×, a betting multiple 3×, a betting multiple 5×, and a betting multiple 10×.

Figure 6:
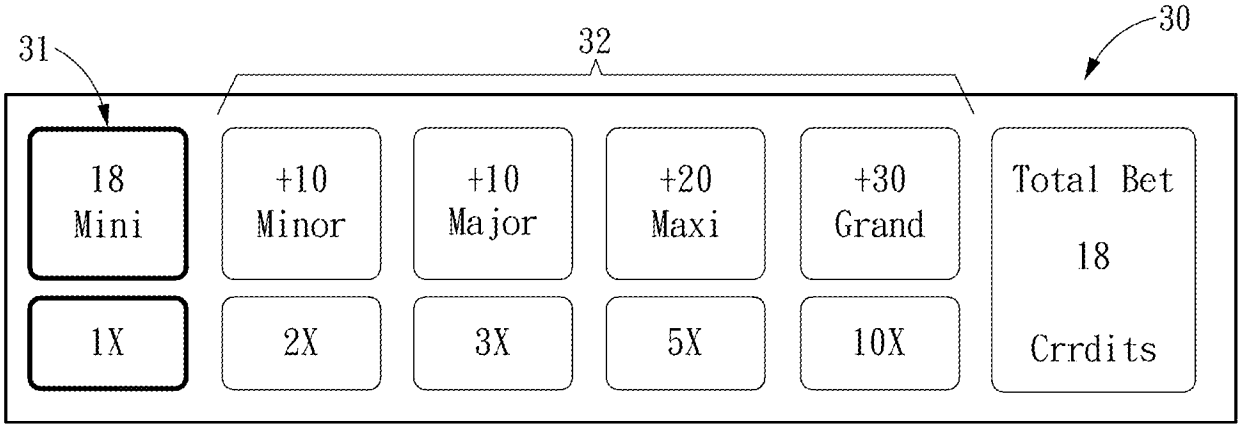
FIG. 6 is a first schematic diagram of a screen of an operation interface of a first embodiment of the present invention.

As shown in FIGS. 4, 5, 6 and 7, the prize money values 42 correspond to the plurality of optional betting options 32 respectively. In more detail, one of the prize money values 42 of the prize money pool unit 40 is a basic prize money value which corresponds to the mandatory betting option 31, and the remaining prize money values 42 correspond to the plurality of optional betting options 32 respectively. When the mandatory betting signal is generated, the control unit 70 controls the prize money pool unit 40 to activate the basic prize money value. That is to say, it is possible for the player to obtain the basic prize money value as well as the player bets on the mandatory betting option 31. During actual implementation, in the embodiments shown in FIGS. 4, 6 and 7, the mandatory betting option 31 is a point betting option 18. The plurality of optional betting options 32 include the point betting option +10, the point betting option +10, the point betting option +20 and the point betting option +30. The point betting option 18 of the mandatory betting option 31 corresponds to the basic prize money value, i.e., Mini, and the point betting option +10, the point betting option +10, the point betting option +20 and the point betting option +30 of the plurality of optional betting options 32 correspond to prize money values 42 of awards, i.e., Minor, Major, Maxi and Grand respectively. In addition, the operation interface 30 further has betting multiples of 1×, 2×, 3×, 5×, 10×, etc for selection, and the bet amount of the mandatory betting option 31 can be increased by multiplying directly by the selected multiple. As shown in FIG. 6, the player bets on the mandatory betting option 31 and selects the multiple "1×" (indicated by a thick box) so that the total bet points are 18 (18×1).

Figure 7:
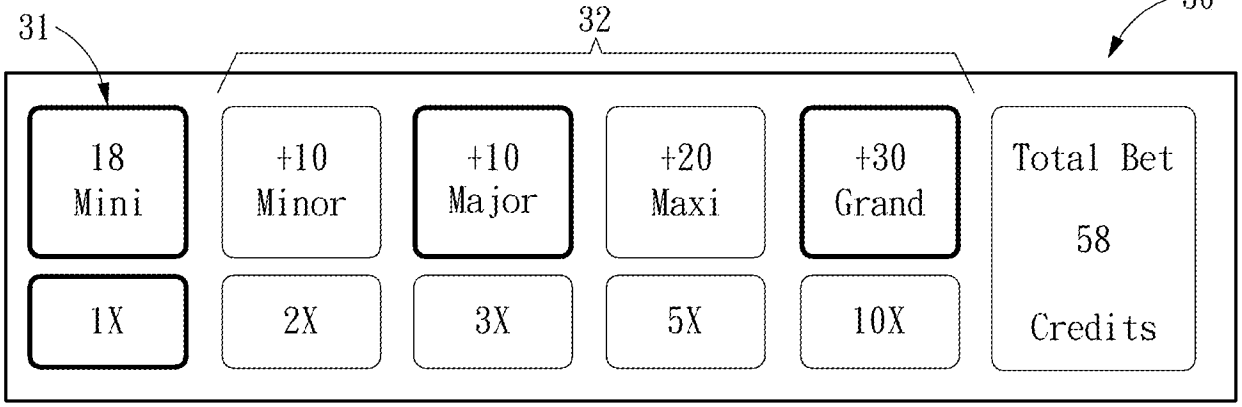
FIG. 7 is a second schematic diagram of the screen of the operation interface of the first embodiment of the present invention.

As also shown in FIGS. 4 and 7, in addition to betting on the mandatory betting option 31 and selecting the betting multiple "1×", the player further bets on two optional betting options 32 (indicated by thick boxes in FIGS. 4 and 7, i.e., the "point betting option +10" and the "point betting option +30"), and the total bet points are 58 (i.e., (18+10+30)×1). In this case, the prize money value 42, i.e., "Mini", corresponding to the point betting option 18 of the mandatory betting option 31 will be activated, and presented in a state in which it may be triggered and won. Moreover, the prize money values 42, i.e., "Major" and "Grand", corresponding to the point betting option "+10" and the point betting option "+30" of the optional betting options 32 will also be activated, and presented in a state in which they may be triggered and won.

Figure 2:
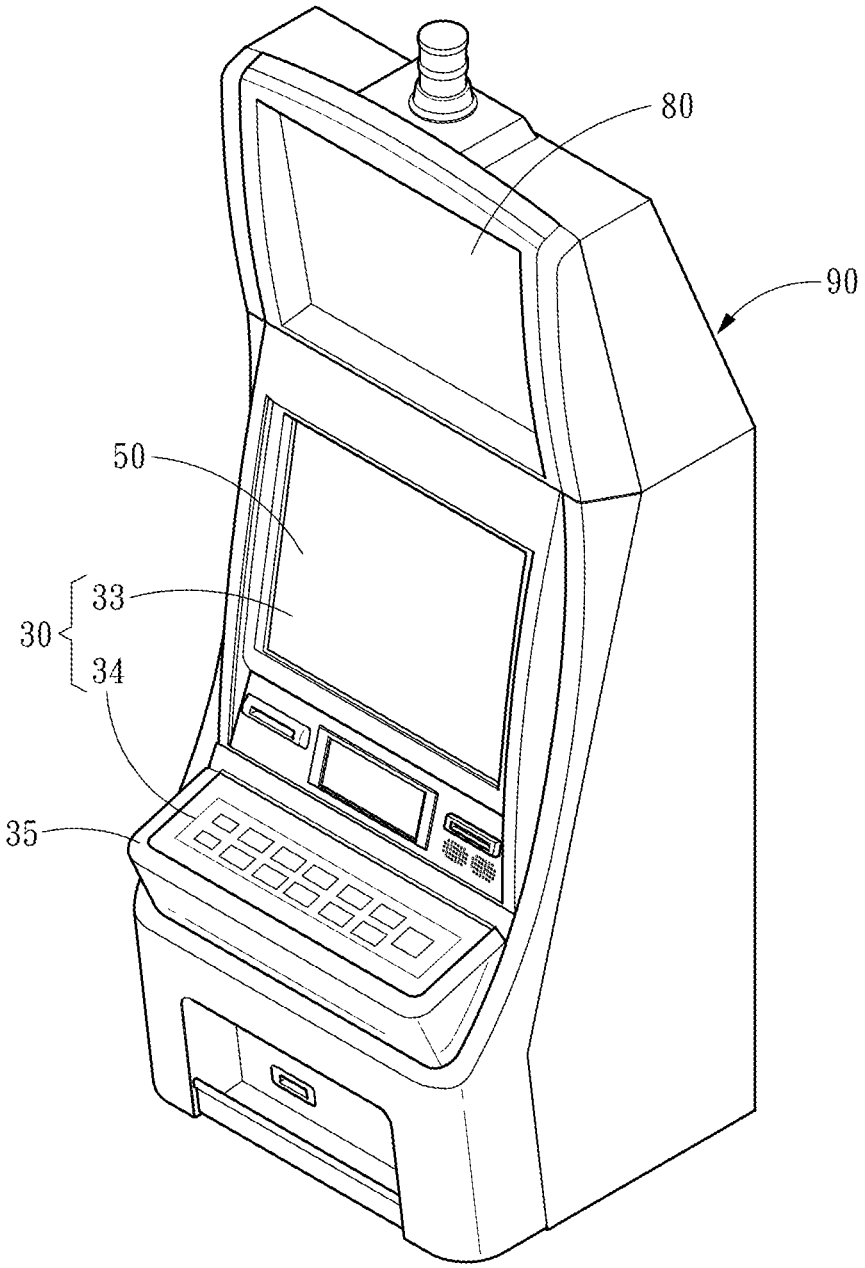
FIG. 2 is a schematic diagram of a gaining machine of the present invention.

As shown in FIGS. 2 and 4, in the embodiment, the game system of the present invention is applied to a gaining machine 90. The display unit 50 may be a touch screen. The operation interface 30 is integrated into the display unit 50. The operation interface 30 switches betting selection or betting closure for the player in a manner of clicking the screen. More preferably, the operation interface 30 of the present embodiment is provided with a first operation interface 33 and a second operation interface 34. The first operation interface 33 is integrated into the display unit 50, for the player to operate in a touch manner of clicking the screen. The player switches the betting selection or the betting closure by directly clicking the screen so as to bet on the mandatory betting option 31 and the plurality of optional betting options 32. The second operation interface 34 is another touch screen of a smaller size, which is disposed on an operation platform 35 and is mainly used for displaying the mandatory betting option 31 and the plurality of optional betting options 32, as shown in FIGS. 6, 7, 8 and 9. In other implementation manners, the operation interface 30 may be integrated into the display unit 50 only, or may be disposed on the operation platform 35 only in a form of a small touch screen, or may be disposed on the operation platform 35 in an another form of buttons, or may be disposed in a form of any combination of various implementation manners thereof. As shown in FIG. 2, the operation interface 30 is integrated into the display unit 50 while being additionally disposed on the operation platform 35 in a form of a small touch screen. In addition, the operation interface 30 may also be integrated into the display unit 50 while being additionally disposed on the operation platform 35 in a form of buttons.

Figure 8:
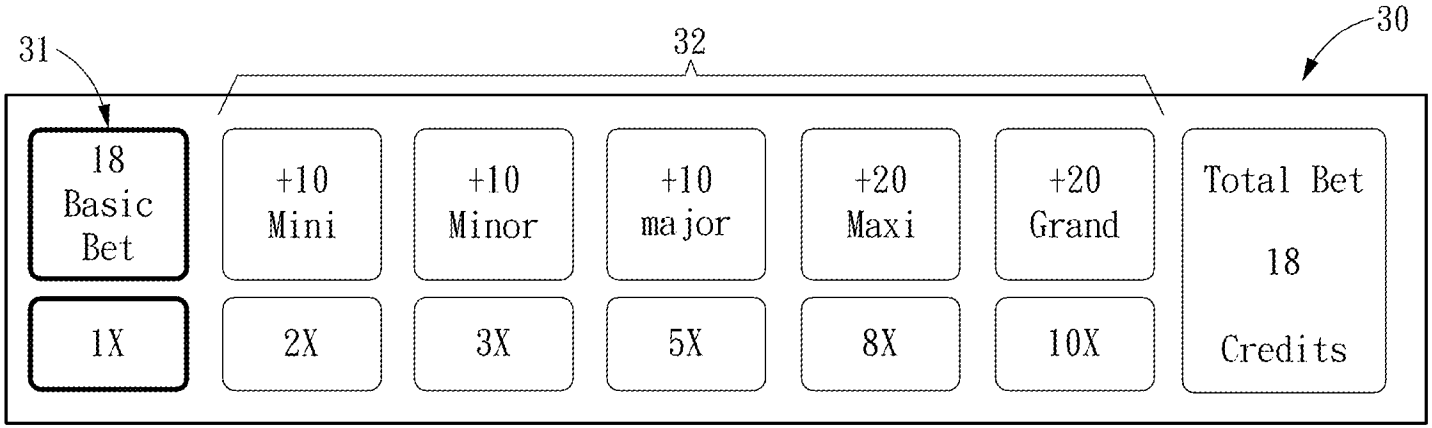
FIG. 8 is a first schematic diagram of a screen of an operation interface of a second embodiment of the present invention.
Figure 9:
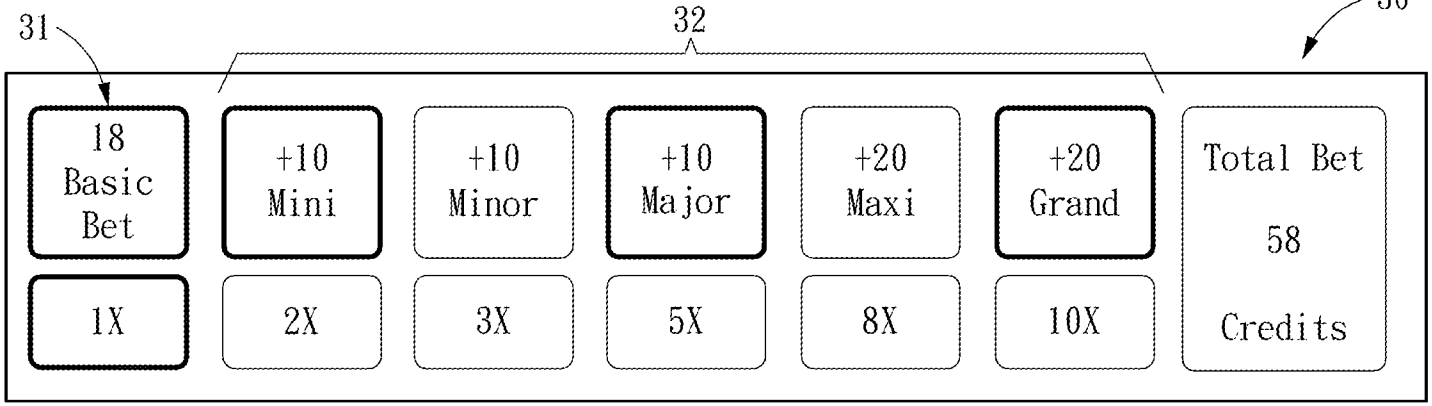
FIG. 9 is a second schematic diagram of the screen of the operation interface of the second embodiment of the present invention.

FIGS. 8 and 9 illustrate an implementation manner in which a basic prize money value is absent. The plurality of prize money values 42 are in one-to-one correspondence to the plurality of optional betting options 32, however, the mandatory betting option 31 does not correspond to any of the prize money values 42. As shown in FIGS. 8 and 9, the plurality of optional betting options 32 include a point betting option +10, a point betting option +10, a point betting option +10, a point betting option +20 and a point betting option +20, which correspond to prize money values 42 of awards, i.e., Mini, Minor, Major, Maxi and Grand respectively. As shown in FIG. 8, if the player only bets on the mandatory betting option 31, since there is no corresponding prize money value 42, none of the prize money values 42 will be activated. As also shown in FIG. 9, if the player bets on three optional betting options 32 (indicated by thick boxes in FIG. 9), i.e., the point betting option +10 (Mini), the point betting option +10(Major) and the point betting option +20(Grand), the total bet amount being 58, in addition to the mandatory betting option 31, the corresponding three prize money values 42 (Mini, Major and Grand) may be activated, and presented in a state in which they may be triggered and won.

Moreover, the display unit 50 may display the number of the points that the player currently owns in real time according to the point signal, and displays the betting status of the player on the game screen according to the mandatory betting signal and the plurality of optional betting signals.

Figure 3:
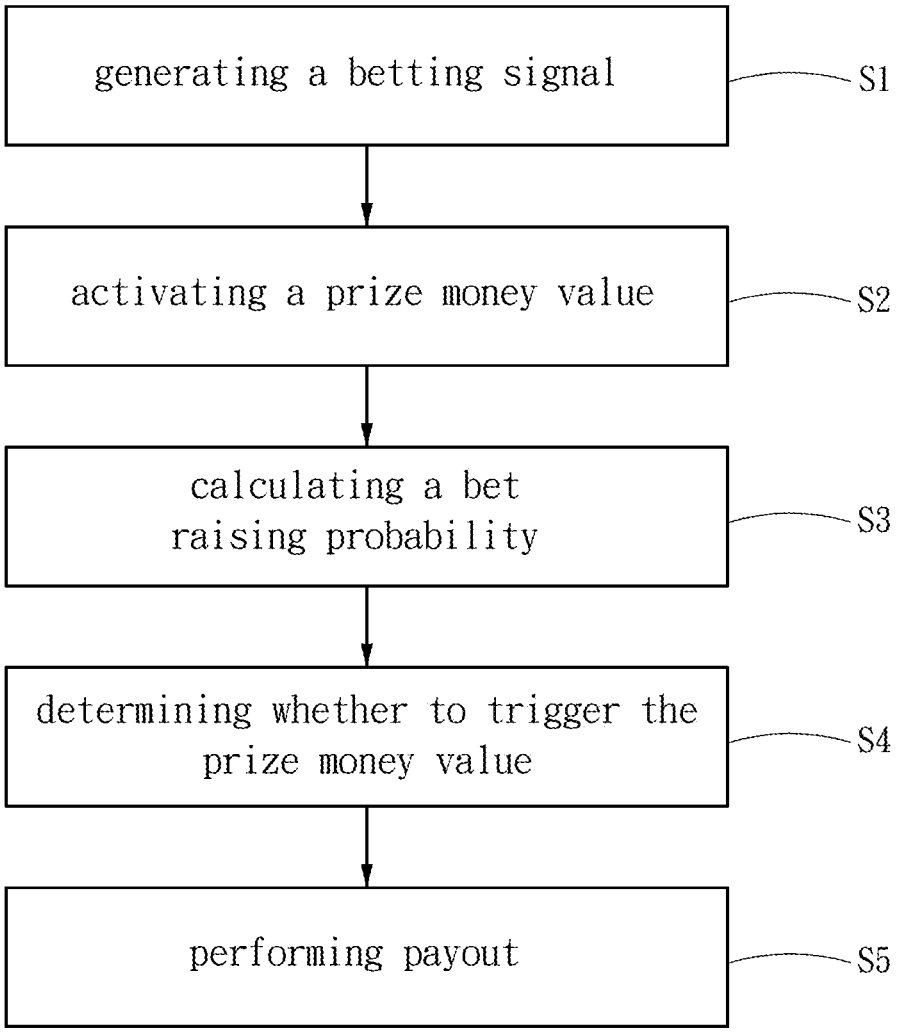
FIG. 3 is an operating flowchart of the present invention.

Then, as shown in FIGS. 1 and 3, the payout unit 60 pays out on the player after a game result is generated. The control unit 70 is connected to the point unit 10, the game result generating unit 20, the operation interface 30, the prize money pool unit 40, the payout unit 60 and the display unit 50. The control unit 70 controls the game to undergo the following steps S1 to S5.

Step S1, generating a betting signal. The control unit 70 activates the operation interface 30 for the player to operate after receiving the point signal generated by the point unit 10; the operation interface 30 generates the mandatory betting signal and the plurality of optional betting signals according to the operations of the player, and modifies the point signal to deduct a portion for betting; after the point signal is modified in the step S1, the control unit 70 further controls the display unit 50 to display a point value corresponding to the point signal.

Step S2: activating the prize money values. The control unit 70 controls the prize money pool unit 40 to activate the corresponding prize money values 42 after obtaining the mandatory betting signal and the plurality of optional betting signals; in terms of the embodiments as shown in FIGS. 4 and 7, the player bets on the mandatory betting option 31 and two of the optional betting options 32, i.e., corresponding to the point betting option 18(mini), the point betting option +10 (Major) and the point betting option +30 (Grand) respectively, and the corresponding prize money values 42 are Mini, Major and Grand. The control unit 70 controls the display unit 50 to display the prize money values 42 that have been activated, and as shown in FIG. 4, the prize money values 42 that have been activated are indicted by thick boxes. The control unit 70 controls the prize money pool unit 40 to obtain the bet amounts of the mandatory betting signal and the plurality of optional betting signals, such that the prize money pool unit 40 allocates a rated proportion of the bet amounts of the mandatory betting signal and the plurality of optional betting signals as an allocation value, and controls the prize money pool unit 40 to cause the database 41 to accumulate the allocation value and to increase the prize money values 42 by the allocation value. In addition, the database 41 increases the prize money values 42 that have been activated by a distribution proportion of the allocation value. Alternatively, the database 41 increases the plurality of prize money values 42 that have been activated and the plurality of prize money values 42 that are not correspondingly activated by betting by a distribution proportion of the allocation value. It should be noted that the distribution proportions received by the respective prize money values 42 may be the same or different. When the prize money values 42 that have not been activated by betting are still increased according to the distribution portions of the allocation value prize money, the player who is playing can be prompted to change his mind to additionally select the optional betting option 32 that was not previously selected to make a bet or to attract other players who have not played the game to make bets.

Step S3: calculating a bet raising probability. The control unit 70 calculates a corresponding bet raising probability respectively according to the bet amounts of the optional betting signals, and randomly generates a corresponding random prize money numeral code. In other words, each of the optional betting signals will have a corresponding bet raising probability and a corresponding random prize money numeral code. The bet raising probability is positively correlated with the bet amounts of the optional betting signals, and may be increased in equal proportion, exponentially or other relationship, so that the higher the bet amounts of the optional betting signals, the higher the corresponding bet raising probability.

Step S4: determining whether to trigger the prize money values. The control unit 70 determines whether a prize money triggering condition corresponding to the prize money values 42 is satisfied according to the bet raising probability and the random prize money numeral code; the control unit 70 controls the display unit 50 to display the prize money values 42 when the prize money triggering condition is satisfied, and controls the database 41 of the prize money pool unit 40 to reset the triggered prize money values 42 to an initial value. The higher the bet raising probability, the more easily satisfied the prize money triggering condition. Moreover, when the player selects to bet on a plurality of optional betting options, each of the prize money values corresponding to the selected optional betting options have a chance to be triggered, thereby increasing the chance of winning There are several ways for the player to get the numerical values of prize money values 42, and two determination mechanisms are enumerated as follows: (1) the prize money pool unit 40 broadcasts the numerical values of the prize money values 42 to the control unit 70 at every fixed time interval, and allocates the prize money value 42 in the most recently received broadcast to the player when the prize money trigger condition is satisfied and triggered. (2) When the prize money triggering condition is satisfied and triggered, the control unit 70 requests the prize money pool unit 40 to obtain the numerical values of the current prize money values 42 or the triggered prize money values 42.

Step S5: performing payout. After the game result generating unit 20 generates the game result, the control unit 70 controls the payout unit 60 to modify the point signal to increase a payout portion to pay out on the player according to the game result, the mandatory betting signal, the optional betting signals and the triggered prize money values. For example, after the game result generating unit 20 generates the game result, the player may win a basic game award according to the game result, and also trigger at least one prize money value, and both of which may be presented separately, simultaneously or one after the other and paid to the player.

It should be noted that the foregoing drawings and descriptions are directed to one mandatory betting option and a plurality of optional betting options. In other implementation manners, there may be only a single mandatory betting option and a single optional betting option, and the single optional betting option corresponds to a single prize money value. Those skilled in the art of the present invention will be able to easily conceive the implementation details of this manner, which will not be described again.

Figure 10:
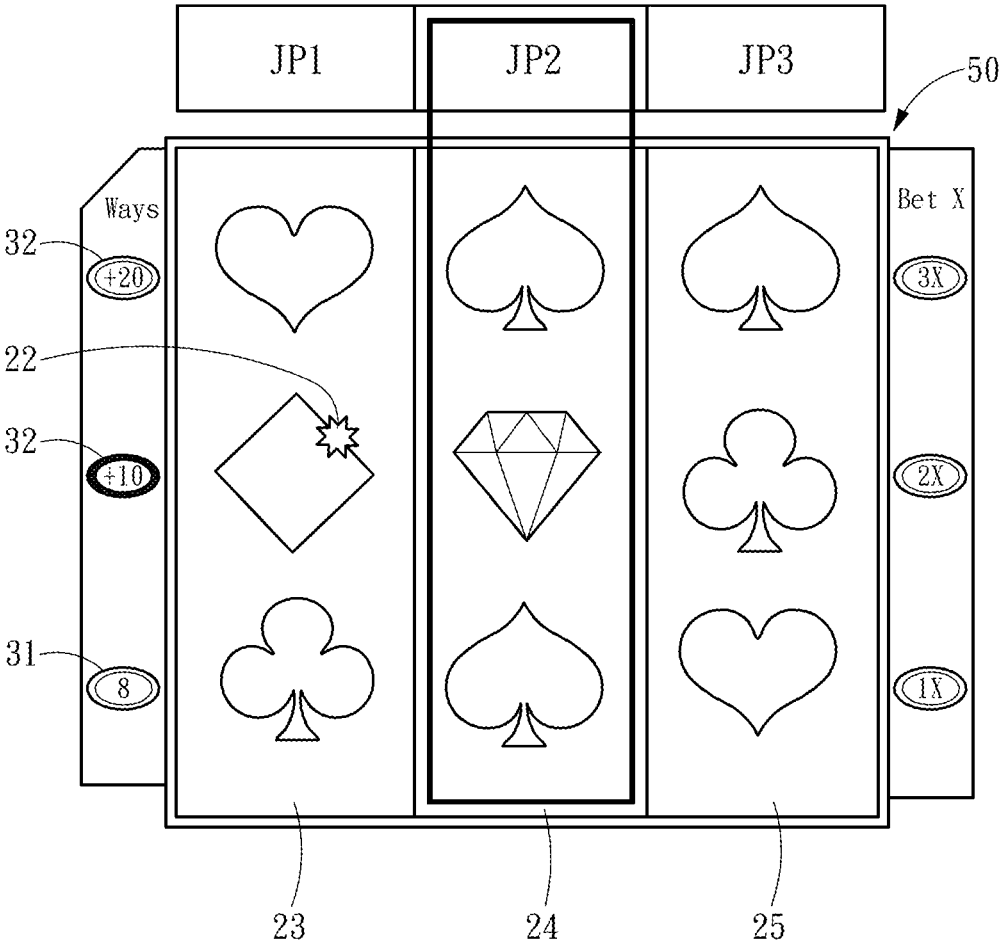
FIG. 10 is a schematic diagram of a screen applied to a WAY game of the present invention.
Figure 11:
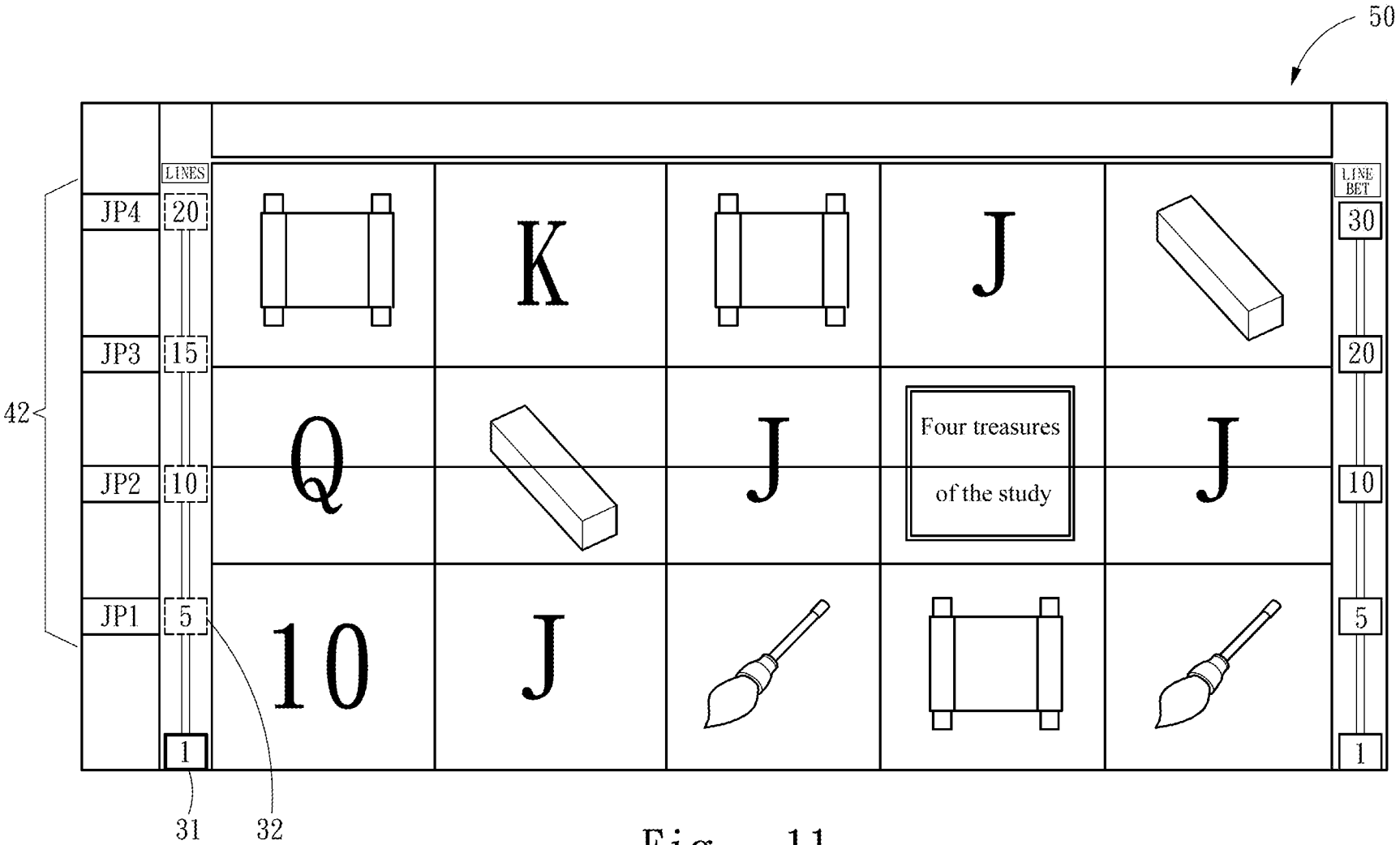
FIG. 11 is a schematic diagram of a screen applied to a LINE game of the present invention.

As shown in FIGS. 10 and 11, the plurality of slots 21 may subjected to a plurality of selection combinations. The selection combinations may be divided into two conditions, wherein the first combination is selected from the mandatory betting option 31 and the optional betting options 32 and the second combination is selected only from the optional betting options 32. In more detail, the plurality of selection combinations of the slots 21 may be divided into "betting WAY" (as shown in FIG. 10) and "betting LINE" (as shown in FIG. 11). That is to say, the mandatory betting option 31 and the optional betting options 32 respectively correspond to any one of betting LINE or betting WAY. When the player bets on any one of the mandatory betting option 31 or the optional betting options 32, i.e., the player bets on the corresponding "LINE" or "WAY", and the numerical values of the prize money value 42 corresponding to the mandatory betting option 31 or the optional betting options 32 will be listed next to the corresponding "LINE" or "WAY", i.e., displayed next to the optional betting options 32, for the player to know clearly, thereby achieving the effect of attracting players to make bets.

In order to allow the player to clearly distinguish the selection combinations of the slots 21, different selection combinations of the slots 21 may have different visual representation effects. FIG. 10 illustrates a schematic diagram of a screen of the present invention applied to "betting WAY". A first slot 23, a second slot 24 and a third slot 25 are illustrated in FIG. 10, which respectively correspond to the first prize money value JP1, the second prize money value JP2 and the third prize money value JP3. The mandatory betting option 31 (e.g. the point betting option 8) corresponds to the first prize money value JP1 and the first slot 23; the optional betting option 32 (e.g. the point betting option +10) corresponds to the second prize money value JP2 and the second slot 24; the optional betting option 32 (e.g. the point betting option +20) corresponds to the third prize money value JP3 and the third slot 25. The prize money value 42 (e.g. JP2) may be directly set above the second slot 24. In addition, the second slot 24 together with JP2 may be added with a special visual effect, and represented by a black frame as a whole, as shown in FIG. 10. Similarly, the first slot 23 and the third slot 25 may also be processed in the same manner. In other implementation manners, the slot below the prize money value corresponding to the optional betting option 32 selected by the player may be highlighted by using different background colors, adding animations, or the like.

If the player wants to get the second prize money value JP2 and the third prize money value JP3, the player must bet on the optional betting option 32 (bet +10) and the optional betting option 32 (bet +20). Therefore, when the prize money value 42 (JP2) and the prize money value 42 (JP3) are accumulated to a considerable numerical value, the player can be attracted to bet and to increase the bet amount, thereby meeting the demand for increased turnover.

Furthermore, as shown in FIG. 10, the game symbols of the present invention may further include a lottery symbol 22 which may be independent of the game symbols each other. As shown in FIG. 10, the lottery symbols 22 may be randomly superimposed on the game symbols, and in other implementation manners, may be integrated into the game symbols. When the lottery symbol 22 appears in any one of the slots 21, the control unit 70 controls the prize money pool unit 40 to additionally perform a step of determining whether the prize money value 42 corresponding to the lottery symbol 22 satisfies the prize money triggering condition once. In order to encourage the player to make more bets, the lottery symbol 22 may appear on the slots 21 corresponding to the optional betting options 32 that are selected and betted in design to encourage the player to make more bets. In this case, the prize money value 42 corresponding to the lottery symbol 22 is the prize money value 42 that corresponds to the mandatory betting option 31 and the optional betting options 32, which are selected and betted.

FIG. 11 illustrates a schematic diagram of a screen of the present invention applied to "betting LINE". As shown in FIG. 11, there are LINE1, LINE 5, LINE 10, LINE 15 and LINE20, wherein LINE 1 is the mandatory betting option 31 and LINE 5, LINE 10, LINE 15 and LINE 20 are the optional betting options 32 and correspond to the prize money values 42 (JP1, JP2, JP3 and JP4), respectively. As shown in FIG. 11, if the player only bets on the mandatory betting option 31, since there is no corresponding prize money value 42, none of the prize money value 42 will be activated. If the player wants to activate the prize money value 42 (JP3), the player must bet on the optional betting option 32 (LINE 15) to activate the prize money value 42 (JP3).

It should be noted that when the player bets on a plurality of optional betting options 32, the steps of calculating a bet raising probability and randomly generating a random prize money numeral code (in step S3), and determining whether to trigger the prize money value (in step S4) are operated independently respectively, i.e., respective betted optional betting options 32 will be calculated and subjected to trigger determination respectively. Therefore, in the case of betting on a plurality of optional betting options 32, the player may simultaneously win a plurality of prize money values 42.

Figure 12:
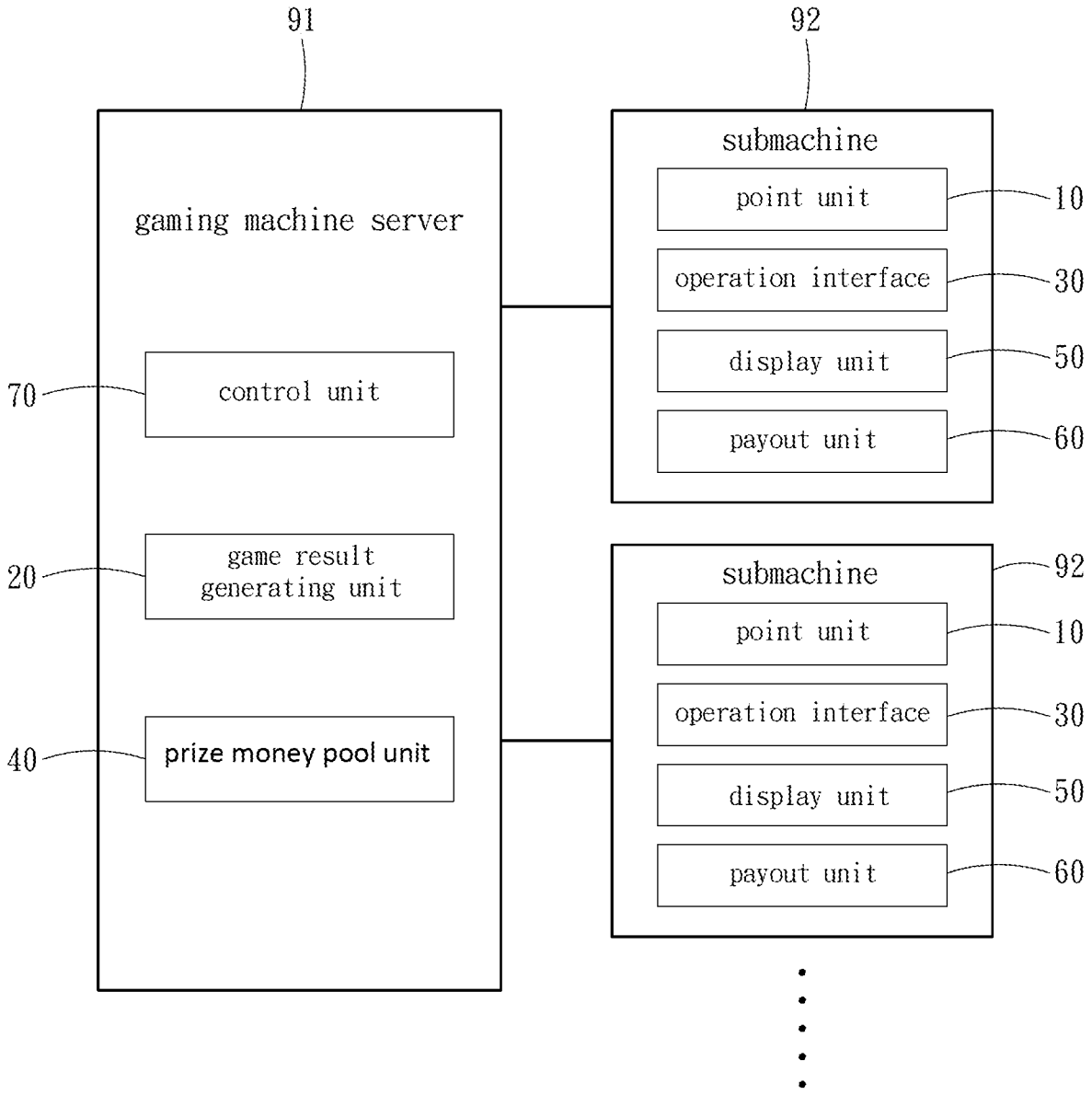
FIG. 12 is an architecture diagram of a system with a plurality of gaining machines of the present invention.

As shown in FIG. 12, the game result generating unit 20, the prize money pool unit 40 and the control unit 70 may be integrated in a gaining machine server 91, and the point unit 10, the operation interface 30, the display unit 50 and the payout unit 60 are disposed on a submachine 92. There may be a plurality of submachines 92, a plurality of players can play respectively on the plurality of submachines 92 by using the gaining machine server 91 in a form of centralized system management, and therefore, the setting cost can be saved.

Figure 13:
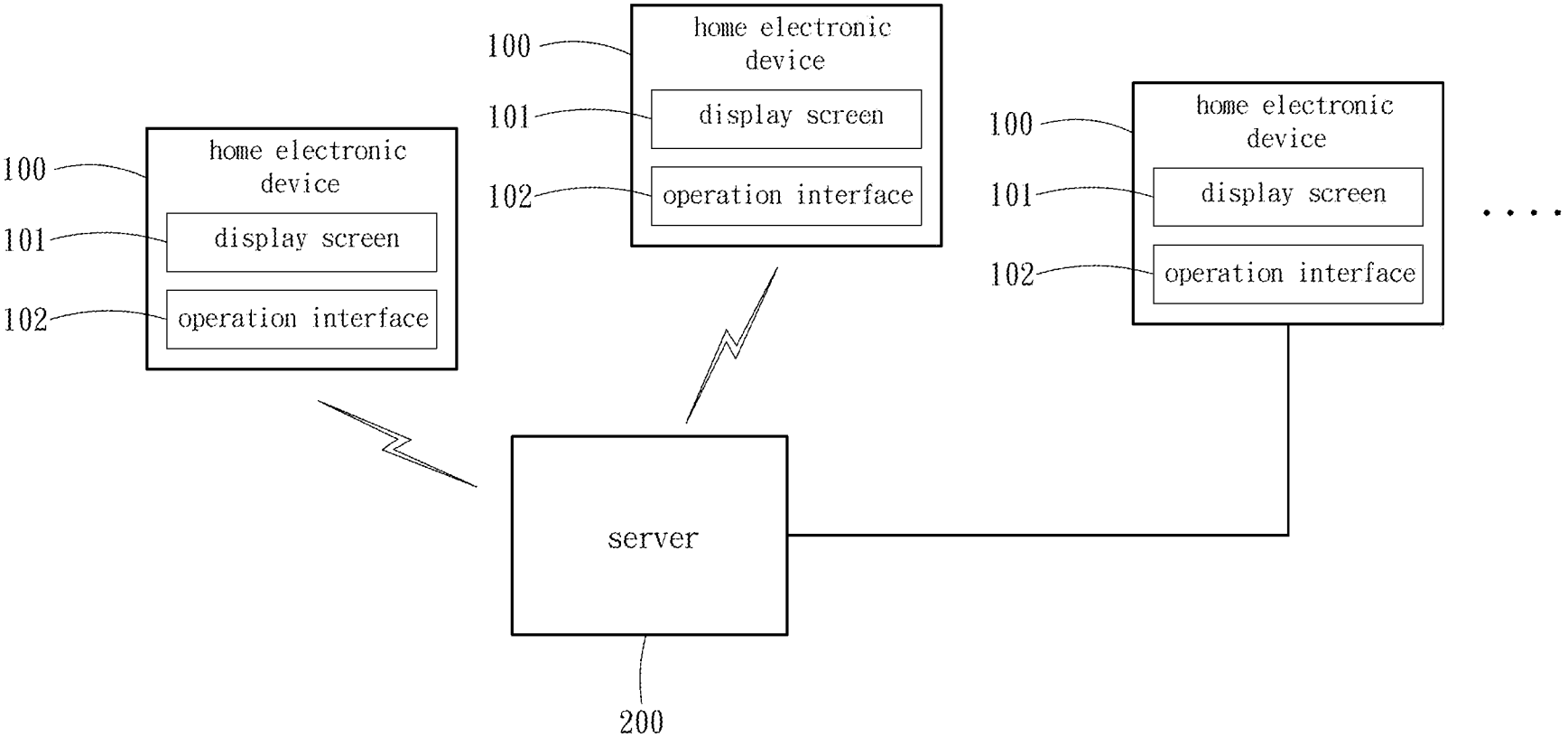
FIG. 13 is an architecture diagram of a system applied to a home electronic device of the present invention.
Figure 14:
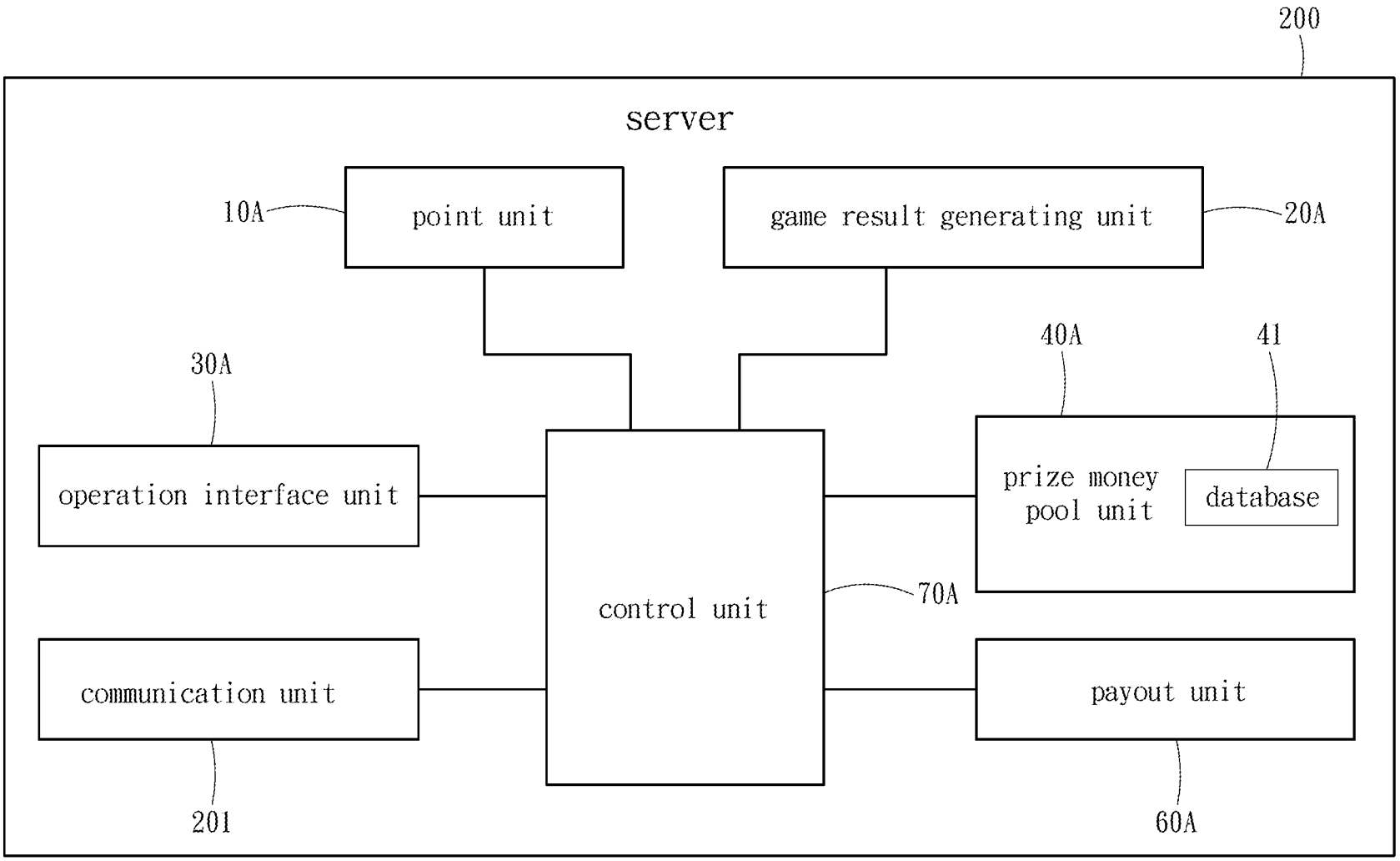
FIG. 14 is an architecture diagram of an internal system applied to the home electronic device of the present invention.

FIG. 13 and FIG. 14 illustrate architecture diagrams of a system applied to a home electronic device in another embodiment of the present invention. Compared with the embodiment in FIG. 1, the game system in the present embodiment is configured for a player to perform a slot game by using a home electronic device 100. The home electronic device 100 may be a computer, a tablet computer, a mobile phone or any electronic device that can get on the Internet at home. The home electronic device 100 is provided with a display screen 101 and an operation interface 102. The game system is formed in a server 200. The server 200 is provided with a communication unit 201 allowing the server 200 to be connected to the home electronic device 100 through signals for intertransmission of communication data. The game system includes a point unit 10A, a game result generating unit 20A, an operation interface unit 30A, a prize money pool unit 40A, a payout unit 60A and a control unit 70A. The operation mode in the present embodiment is substantially the same as that of the previous embodiment, and the difference therebetween will be described as below:

After the game result generating unit 20A generates a game image, the game image is transmitted to the display screen 101 of the home electronic device 100 through the communication unit 201 for display.

The operation interface unit 30A is configured to generate an operation interface signal which is then transmitted to the home electronic device 100 by the communication unit 201, so that the display screen 101 of the home electronic device 100 displays the mandatory betting option and the optional betting options for the player to bet on the mandatory betting option and the optional betting options by using the operation interface 102 of the home electronic device 100 to perform operations. The operation interface 102 generates a corresponding mandatory betting signal and optional betting signals according to the bet amount and transmits the corresponding mandatory betting signal and the optional betting signals back to the operation interface unit 30A. In other words, the operation interface unit 30A serves as an intermediate of the mandatory betting signal and the optional betting signals between the game system in the server 200 and the operation interface 102 on the home electronic device 100 of the player.

As shown in FIG. 3, the control unit 70A is connected to the communication unit 201, the point unit 10A, the game result generating unit 20A, the operation interface unit 30A, the prize money pool unit 40A and the payout unit 60A. The control unit 70A controls the game to undergo the following steps:

Step S1: generating a betting signal. The control unit 70A activates the operation interface unit 30A after receiving a point signal generated by the point unit 10A; the control unit 70A controls the display screen 101 of the home electronic device 100 to display the mandatory betting option and the optional betting options for the player to operate, such that a mandatory betting signal and optional betting signals are generated via the operation interface 102 of the home electronic device 100 and are transmitted back to the game system; the operation interface unit 30A modifies the point signal to deduct a portion for betting according to the transmitted-back mandatory betting signal and optional betting signals.

Step S2: activating prize money values. The control unit 70A controls the prize money pool unit 40A to activate the corresponding prize money values after obtaining the mandatory betting signal and the optional betting signals; the control unit 70A controls, via the communication unit 201, the display screen 101 of the home electronic device 100 to display the prize money values that have been activated.

Step S3: calculating a bet raising probability. The control unit 70A calculates a corresponding bet raising probability according to the bet amount of the optional betting signals, and randomly generates a corresponding random prize money numeral code.

Step S4: determining whether to trigger the prize money values. The control unit 70A determines whether a prize money triggering condition corresponding to the prize money values is satisfied according to the bet raising probability and the random prize money numeral code; the control unit 70A controls, via the communication unit 201, the display screen 101 of the home electronic device 100 to display the prize money values when the prize money triggering condition is satisfied, and controls the database 41 of the prize money pool unit 40A to reset the triggered prize money values to an initial value.

Step S5: performing payout. After the game result generating unit 20A generates a game result, the control unit 70A controls the payout unit 60A to modify the point signal to increase a payout portion according to the game result, the mandatory betting signal, the optional betting signals and the triggered prize money value, and to pay out on the player.

Furthermore, the display screen 101 of the home electronic device 100 may be a touch screen. The operation interface 102 of the home electronic device 100 is integrated into the display screen 101, such that the player may perform a betting operation via the touch screen. The player may switch betting selection or betting closure via the operation interface 102 of the home electronic device 100 in a manner of clicking the screen. In addition, the control unit 70A controls, via the communication unit 201, the display screen 101 of the home electronic device 100 to display a point value corresponding to the point signal. Further, after the point signal is modified in step S1, the control unit 70A controls, via the communication unit 201, the display screen 101 of the home electronic device 100 to display the point value corresponding to the point signal.

From the above, the present invention has the following characteristics:

1. the plurality of prize money values correspond to the optional betting options respectively, such that the players can choose the corresponding optional betting options to bet according to their own preferences, betting habits or the prize money values that are most likely to be obtained after observation, thereby preventing the players feeling be taken advantage of and effectively increasing extra willing of the players to bet. 2. The display unit will display the prize money values that have been activated, thereby increasing the willing of the players to bet. 3. The entertainment, uncertainty and excitement of the game will be increased through the setting of the lottery symbol. 4. The game system is suitable for stand-alone gaining machines, including stand-alone prize money and multiplayer online prize money, also suitable for ONLINE models, and can be implemented by the players by using the home electronic device to meet the requirement on long-distance playing.

What is claimed is:

1. A game system capable of triggering prize money by multiple betting, for a player to perform a slot game, the game system comprising:

a point unit configured to retrieve any one of a ticket data and an account data, and generate a point signal according to a point in the ticket data and the account data;

a game result generating unit, in the case where the slot game has a plurality of slots arranged in a matrix form and a plurality of game symbols, configured to randomly select game symbols from the plurality of game symbols and display the selected game symbols on the plurality of slots, and determine a game result and generate a game image;

an operation interface including a mandatory betting option and at least one optional betting option, the operation interface configured for the player to perform betting on the mandatory betting option and the at least one optional betting option, and generate a corresponding mandatory betting signal and at least one optional betting signal according to bet amounts of the mandatory betting option and the at least one optional betting option;

a prize money pool unit including a database for storing at least one prize money value, the at least one prize money value corresponding to the at least one optional betting option;

a display unit configured to display the game image;

a payout unit configured to pay out on the player; and a control unit connected to the point unit, the game result generating unit, the operation interface, the prize money pool unit, the display unit and the payout unit and configured to control the game to undergo the following steps:

Step S1: generating a betting signal, wherein the control unit activates the operation interface for the player to operate after receiving the point signal generated by the point unit, and the operation interface generates the mandatory betting signal and the at least one optional betting signal according to operations of the player, and modifies the point signal to deduct a portion for betting;

Step S2: activating a prize money value, wherein the control unit controls the prize money pool unit to activate the corresponding at least one prize money value after obtaining the mandatory betting signal and the at least one optional betting signal, the control unit controls the display unit to display the at least one prize money value that has been activated and controls the prize money pool unit to obtain the bet amounts of the mandatory betting signal and the at least one optional betting signal, such that the prize money pool unit allocates a rated proportion of the bet amounts of the mandatory betting signal and the at least one optional betting signal as an allocation value, and controls the prize money pool unit to cause the database to accumulate the allocation value and to increase the at least one prize money value by the allocation value;

Step S3: calculating a bet raising probability, wherein the control unit calculates a corresponding bet raising probability according to the bet amount of the at least one optional betting signal, and randomly generates a corresponding random prize money numeral code;

Step S4: determining whether to trigger the prize money value, wherein the control unit determines whether a prize money triggering condition corresponding to the at least one prize money value is satisfied according to the bet raising probability and the random prize money numeral code, and the control unit controls the display unit to display the at least one prize money value when the prize money triggering condition is satisfied, and controls the database of the prize money pool unit to reset the triggered at least one prize money value to an initial value; and Step S5: performing payout, wherein after the game result generating unit generates the game result, the control unit controls the payout unit to modify the point signal to increase a payout portion to pay out on the player according to the game result, the mandatory betting signal, the at least one optional betting signal and the triggered prize money value.

2. The game system according to claim 1, wherein the display unit is a touch screen, and the operation interface is integrated into the display unit.

3. The game system according to claim 2, wherein the operation interface is switched by the player in a manner of clicking the touch screen to select betting and close betting.

4. The game system according to claim 1, wherein the control unit controls the display unit to display a point value corresponding to the point signal after the point unit generating the point signal.

5. The game system according to claim 1, wherein the control unit controls the display unit to display a point value corresponding to the point signal after modifying the point signal in the step S1.

6. The game system according to claim 1, wherein the at least one optional betting option is a plurality of optional betting options, and the at least one prize money value is a plurality of prize money values.

7. The game system according to claim 6, wherein the plurality of prize money values are in one-to-one correspondence to the plurality of optional betting options.

8. The game system according to claim 1, wherein the prize money pool unit further comprises a basic prize money value which corresponds to the mandatory betting option; and when the mandatory betting signal is generated, the control unit controls the prize money pool unit to activate the basic prize money value.

9. The game system according to claim 1, wherein the plurality of game symbols further include a lottery symbol; and when the lottery symbol appears in any one of the plurality of slots, the control unit controls the prize money pool unit to additionally perform a step of determining whether the prize money value corresponding to the lottery symbol satisfies the prize money triggering condition once.

10. The game system according to claim 1, wherein the plurality of slots are subjected to a plurality of selected combinations which are selected from the mandatory betting option and the at least one optional betting option.

11. The game system according to claim 10, wherein the plurality of game symbols further include a lottery symbol; and when the lottery symbol appears in any one of the plurality of slots, the control unit controls the prize money pool unit to additionally perform a step of determining whether the prize money value corresponding to the lottery symbol satisfies the prize money triggering condition once.

12. The game system according to claim 1, wherein the plurality of slots are subjected to a plurality of selected combinations which are selected from the at least one optional betting options.

13. The game system according to claim 12, wherein the plurality of game symbols further include a lottery symbol; and when the lottery symbol appears in any one of the plurality of slots, the control unit controls the prize money pool unit to additionally perform a step of determining whether the prize money value corresponding to the lottery symbol satisfies the prize money triggering condition once.

14. The game system according to claim 13, wherein the lottery symbol will appear on the one of the plurality of slot corresponding to the at least one optional betting option being bet.

15. The game system according to claim 10, wherein the selected combinations of the plurality of slots correspond to any one of betting LINE and betting WAY.

16. The game system according to claim 12, wherein the selected combinations of the plurality of slots correspond to any one of betting LINE and betting WAY.

17. The game system according to claim 6, wherein the mandatory betting option and the plurality of optional betting options respectively correspond to at least one of a point betting option, a betting multiple or a total bet amount.

18. The game system according to claim 1, wherein the database increases the at least one prize money value that has been activated by the allocation value, according to a distribution proportion.

19. The game system according to claim 6, wherein the database increases the plurality of prize money values that have been activated and the plurality of prize money values that are not correspondingly activated by betting by the allocation value, according to a distribution proportion.

20. The game system according to claim 1, wherein the point unit, the game result generating unit, the operation interface, the display unit, the payout unit and the control unit are integrated into a gaining machine.

21. The game system according to claim 1, wherein the game result generating unit, the prize money pool unit and the control unit are integrated into a gaining machine server.

22. The game system according to claim 1, wherein numerical values of the at least one prize money value is correspondingly displayed next to the at least one optional betting option.

23. A game system capable of triggering prize money by multiple betting, for a player to perform a slot game by using a home electronic device, wherein the home electronic device is provided with a display screen and an operation interface, the game system is formed inside a server, and the server is provided with a communication unit allowing the server and the home electronic device to be connected through signals for intertransmission of communication data, the game system including:

a point unit configured to retrieve an account data, and generate a point signal according to a point in the account data;

a game result generating unit configured to, in the case where the slot game has a plurality of slots arranged in a matrix form and a plurality of game symbols, randomly select game symbols from the plurality of game symbols and display them on the plurality of slots, and determine a game result and generate a game image, wherein the game image is transmitted to the display screen of the home electronic device via the communication unit and the game image is displayed on the display screen;

an operation interface unit configured to generate an operation interface signal which is then transmitted to the home electronic device via the communication unit, such that the display screen of the home electronic device displays a mandatory betting option and at least one optional betting option, the player can perform betting on the mandatory betting option and the at least one optional betting option by using the operation interface of the home electronic device, and the operation interface generates a corresponding mandatory betting signal and at least one optional betting signal according to the bet amount of the mandatory betting option and the at least one optional betting option and transmits the same to the operation interface unit;

a prize money pool unit including a database for storing at least one prize money value, the at least one prize money value corresponding to the at least one optional betting option;

a payout unit configured to pay out on the player; and a control unit connected to the communication unit, the point unit, the game result generating unit, the operation interface unit, the prize money pool unit and the payout unit and configured to control the game to undergo the following steps:

Step S1: generating a betting signal, wherein the control unit activates the operation interface unit after receiving the point signal generated by the point unit, the control unit controls the display screen of the home electronic device to display the mandatory betting option and the at least one optional betting option for the player to operate, such that the mandatory betting signal and the at least one optional betting signal are generated via the operation interface of the home electronic device and are transmitted back to the game system, the operation interface unit modifies the point signal to deduct a portion for betting according to the transmitted-back mandatory betting signal and the at least one optional betting signal;

Step S2: activating a prize money value, wherein the control unit controls the prize money pool unit to activate the corresponding at least one prize money value after obtaining the mandatory betting signal and the at least one optional betting signal, the control unit controls, via the communication unit, the display screen of the home electronic device to display the at least one prize money value that has been activated and controls the prize money pool unit to obtain the bet amounts of the mandatory betting signal and the at least one optional betting signal, such that the prize money pool unit allocates a rated proportion of the bet amounts of the mandatory betting signal and the at least one optional betting signal as an allocation value, and controls the prize money pool unit to cause the database to accumulate the allocation value and to increase the at least one prize money value by the allocation value;

Step S3: calculating a bet raising probability, wherein the control unit calculates a corresponding bet raising probability according to the bet amount of the at least one optional betting signal, and randomly generates a corresponding random prize money numeral code;

Step S4: determining whether to trigger the prize money value, wherein the control unit determines whether a prize money triggering condition corresponding to the at least one prize money value is satisfied according to the bet raising probability and the random prize money numeral code, the control unit controls, via the communication unit, the display screen of the home electronic device to display the at least one prize money value when the prize money triggering condition is satisfied, and controls the database of the prize money pool unit to reset the triggered at least one prize money value to an initial value; and Step S5: performing payout, wherein after the game result generating unit generates the game result, the control unit controls the payout unit to modify the point signal to increase a payout portion according to the game result, the mandatory betting signal, the at least one optional betting signal and the triggered prize money value, and to pay out on the player.

24. The game system according to claim 23, wherein the display screen of the home electronic device is a touch screen, and the operation interface of the home electronic device is integrated into the display screen.

25. The game system according to claim 24, wherein the operation interface of the home electronic device switches betting selection or betting closure for the player in a manner of clicking the touch screen.

26. The game system according to claim 23, wherein the control unit controls, via the communication unit, the display screen of the home electronic device to display a point value corresponding to the point signal after the point unit generating the point signal.

27. The game system according to claim 23, wherein the control unit controls, via the communication unit, the display screen of the home electronic device to display a point value corresponding to the point signal after modifying the point signal in the step S1.

28. The game system according to claim 23, wherein the at least one optional betting option is a plurality of optional betting options, and the at least one prize money value is a plurality of prize money values.

29. The game system according to claim 28, wherein the plurality of prize money values are in one-to-one correspondence to the plurality of optional betting options.

30. The game system according to claim 23, wherein the prize money pool unit further has a basic prize money value which corresponds to the mandatory betting option; and when the mandatory betting signal is generated, the control unit controls the prize money pool unit to activate the basic prize money value.

31. The game system according to claim 23, wherein the plurality of game symbols further include a lottery symbol; when the lottery symbol appears in any one of the plurality of slots, the control unit controls the prize money pool unit to additionally perform a step of determining whether the prize money value corresponding to the lottery symbol satisfies the prize money triggering condition once.

32. The game system according to claim 23, wherein the plurality of slots are subjected to a plurality of selected combinations correspond to the mandatory betting option and the at least one optional betting options.

33. The game system according to claim 32, wherein the plurality of game symbols further include a lottery symbol; when the lottery symbol appears in any one of the plurality of slots, the control unit controls the prize money pool unit to additionally perform a step of determining whether the prize money value corresponding to the lottery symbol satisfies the prize money triggering condition once.

34. The game system according to claim 23, wherein the plurality of slots are subjected to a plurality of selected combinations which correspond to the at least one optional betting option.

35. The game system according to claim 34, wherein the plurality of game symbols further include a lottery symbol; and when the lottery symbol appears in any one of the plurality of slots, the control unit controls the prize money pool unit to additionally perform a step of determining whether the prize money value corresponding to the lottery symbol satisfies the prize money triggering condition once.

36. The game system according to claim 35, wherein the lottery symbol will appear on the one of the plurality of slot corresponding to the at least one optional betting option being bet.

37. The game system according to claim 32, wherein the selected combinations of the plurality of slots correspond to any one of betting LINE and betting WAY.

38. The game system according to claim 34, wherein the selected combinations of the plurality of slots correspond to any one of betting LINE and betting WAY.

39. The game system according to claim 28, wherein the mandatory betting option and the plurality of optional betting options respectively correspond to at least one of a point betting option, a betting multiple or a total bet amount.

40. The game system according to claim 23, wherein the database increases the at least one prize money value that has been activated by the allocation value, according to a distribution proportion.

41. The game system according to claim 28, wherein the database increases the plurality of prize money values that have been activated and the plurality of prize money values that are not correspondingly activated by betting by the allocation value, according to a distribution proportion.

42. The game system according to claim 23, wherein a numerical value of the at least one prize money value is correspondingly displayed next to the at least one optional betting option.

* * * * *